US005364725A

United States Patent [19]

Wilson et al.

[11] Patent Number: 5,364,725

[45] Date of Patent: Nov. 15, 1994

[54] TONER AND DEVELOPER CONTAINING ACYLOXY-T-ALKYLATED BENZOIC ACIDS AS CHARGE-CONTROL AGENT

[75] Inventors: John C. Wilson, Rochester; Steven M. Bonser, Fairport; Thomas A. Jadwin, Rochester, all of N.Y.

[73] Assignee: Eastman Kodak Company, Rochester, N.Y.

[21] Appl. No.: 31,507

[22] Filed: Mar. 15, 1993

[51] Int. Cl.[5] ..... G03G 9/135

[52] U.S. Cl. ..... 430/110

[58] Field of Search ..... 430/106, 110, 111

[56] References Cited

U.S. PATENT DOCUMENTS

| | | | |
|---|---|---|---|
| 3,893,935 | 7/1975 | Jadwin et al. | 252/62.1 |
| 3,944,493 | 3/1976 | Jadwin et al. | 252/62.1 P |
| 4,206,064 | 6/1980 | Kiuchi et al. | 430/106 |
| 4,323,634 | 4/1982 | Jadwin | 430/110 |
| 4,394,430 | 7/1983 | Jadwin et al. | 430/110 |
| 4,404,271 | 9/1983 | Kawagishi et al. | 430/110 |
| 4,496,643 | 1/1985 | Wilson et al. | 430/110 |
| 4,624,907 | 11/1986 | Niimura et al. | 430/106 |
| 4,656,112 | 4/1987 | Kawagishi et al. | 430/110 |
| 4,789,615 | 12/1988 | Ciccarelli et al. | 430/126 |
| 4,834,920 | 5/1989 | Bugner et al. | 260/501.15 |
| 4,845,003 | 7/1989 | Kiriu et al. | 430/110 |
| 4,985,328 | 1/1991 | Kumagai et al. | 430/110 |
| 5,225,300 | 7/1993 | Tsubota et al. | 430/106 |
| 5,227,460 | 7/1993 | Mahabadi et al. | 430/109 |

FOREIGN PATENT DOCUMENTS

| | | |
|---|---|---|
| 54-145542 | 11/1979 | Japan . |
| 55-79454 | 6/1980 | Japan . |
| 59-209194 | 2/1984 | Japan . |
| 61-259271 | 11/1986 | Japan . |
| 62-113589 | 2/1987 | Japan . |
| 62-59084 | 3/1987 | Japan . |
| 62-163061 | 7/1987 | Japan . |

*Primary Examiner*—John Goodrow
*Attorney, Agent, or Firm*—Anne B. Kiernan

[57] ABSTRACT

New electrostatic toners and developers are provided containing new colorless charge-control agents comprising acyloxy-t-alkylated benzoic acids.

21 Claims, No Drawings

TONER AND DEVELOPER CONTAINING ACYLOXY-T-ALKYLATED BENZOIC ACIDS AS CHARGE-CONTROL AGENT

FIELD OF THE INVENTION

This invention relates in general to electrostatography and in particular to toners and developers useful in the development of electrostatic charge images. More specifically, this invention relates to toners and developers which have improved charge-control agents incorporated therein.

BACKGROUND OF THE INVENTION

In electrostatography an electrostatic image is formed on an image member. For example, the electrostatic image can be formed by imagewise exposing a photoconductive image member. Charged toner particles are applied to the electrostatic image member to form a toner image defined by the electrostatic image. The toner particles can be applied to the electrostatic image member via carrier by a well-known development process, for example, cascade development or magnetic brush development. Toner particles and carrier particles together are referred to as developer. (Toner particles are referred to collectively as "toner" and carrier particles are referred to collectively as "carrier".) Developers are formulated such that the toner and carrier will acquire triboelectrical charges of opposite polarity upon mixing. Because the toner and carrier have opposite charges the toner will cling to the surface of the carrier until the developer is brought into contact with the electrostatic image member. When the developer contacts the electrostatic image member, the electrostatic forces (sometimes in combination with an additional applied field) attract and pull the toner away from the carrier and to the electrostatic image member. After the toner image is formed, usually it is transferred from the electrostatic image member to a receiver onto which it is fixed by known methods, for example, by the application of heat and pressure by a fuser member.

In order for the developer to function properly, the electrostatic attractions between the toner particles and the carrier particles must be strong enough to hold the toner to the carrier while the developer is being transported to and brought into contact with the electrostatic image member. However, the electrostatic attraction between the toner and carrier must also be weaker than the electrostatic forces between the toner particles and the area to be toned on the electrostatic image member, so that the toner will separate from the carrier and attach to the electrostatic image member. Therefore, the electrostatic charge between the carrier and toner should be maintained within an optimum range for sufficient toning of the electrostatic image member to occur.

The toner in developers often contains material referred to as charge agent or charge-control agent which helps to establish and maintain the electrostatic charge on toner within the optimum range. Usually negative charge-control agent materials are used in toners to be charged negatively and positive charge-control agent materials are used in toners to be charged positively, but combinations of negative and positive charge-control agent materials can be used in toners to achieve an overall negative or positive charge on the toners. Many types of charge-control agents are described in published patent literature. For example, see U.S. Pat. Nos. 3,893,935; 3,944,493; 4,834,920; 4,323,634; and 4,394,430.

There are problems with the negative charge-control agent materials disclosed in the background art. Firstly, many negative charge-control agents contain metals, for example, metal complexes of salicyclic acid, metal salts of nicotinic acid and zinc complexes of aromatic hydroxycarboxylic acid and others as disclosed in U.S. Pat. Nos. 4,206,064; 4,789,615; 4,656,112; and 4,624,907. Many metal-containing charge-control agents are toxic; therefore, there are health concerns related to their handling and environmental concerns related to their disposal. Secondly, many of the background art negative charge-control agents are colored. Because of their color, these charge-control agents affect the final color of a toner. The effect of the colored charge-control agents on the toner is a particular problem when fabricating non-black toners, for example, the clear, cyan, magenta and yellow toners.

Other considerations in the selection of charge-control agent materials to be utilized in toners and developers is the effect the charge-control agent will have on a toner's propensity to dust during use and its charge-to-mass ratio (Q/M). In general, dusting increases as the absolute value of the Q/M decreases. Low Q/M levels are highly desirable, because theoretically a larger quantity of toner will attach to an electrostatic image member for a given charge; however, when the charge on the toner is too low the toner often will not adhere to the electrostatic image member and instead behaves like dust, contaminating the machine.

It is toward the objective of providing metal-free, colorless negative charge-control agents, which provide toners and developers exhibiting acceptable dusting and Q/M characteristics, that the present invention is directed.

SUMMARY

In accordance with this invention electrostatic toners, and developers are provided comprising acyloxy-t-alkylated benzoic acids.

The acyloxy-t-alkylated benzoic acids are useful as charge-control agents in dry, electrostatographic toners and developers. The toners comprise a polymeric binder, charge-control agent, and addenda, if desired. The charge-control agent may comprise a single acyloxy-t-alkylated benzoic acid, two or more acyloxy-t-alkylated benzoic acids, or one or more acyloxy-t-alkylated benzoic acids combined with one or more known charge-control agent materials. The developers comprise carriers and the toners defined above.

The toners and developers comprising the acyloxy-t-alkylated benzoic acids have acceptable charge-to-mass ratios (Q/M), and have low tendencies to dust. Toners which provide acceptable Q/M and low dusting result in the formation of evenly toned electrostatic images.

In addition, because these acyloxy-t-alkylated benzoic acids are metal-free, they do not present the toxicity and environmental concerns of the metal-containing charge agents. Also, because the acyloxy-t-alkylated charge-control agents are colorless, they will not affect the color of any of the toners into which they are incorporated.

DESCRIPTION

As stated earlier, this invention provides electrostatic toners and developers comprising acyloxy-t-alkylated benzoic acids as charge-control agent. In addition to the charge-control agent, the toners comprise a polymeric toner binder, and may contain addenda, for example, pigments, and release agents. The charge-control agent may comprise a single acyloxy-t-alkylated benzoic acid, two or more acyloxy-t-alkylated benzoic acids, or one or more acyloxy-t-alkylated benzoic acids combined with one or more known charge-control agent materials. "Charge-control agent" used herein can mean one or more charge-control agent materials which act alone or in combination to help establish and maintain the electrostatic charge on toner particles within an optimum range.

The developers of this invention comprise carriers and the above-described toners. The developers are formulated so that the toner particles and carrier particles acquire triboelectrical charges of the opposite polarity when mixed.

The preferred acyloxy-t-alkylated benzoic acids which are used as charge-control agent in the toners and developers of this invention are of the structure:

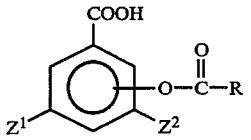

where $Z^1$ and $Z^2$ are independently selected tertiary alkyl groups having from 4 to 8 carbons, preferably, t-butyl, t-octyl and 1-methylcyclohexyl, and R is alkyl having 1 to 12 carbons, preferably 1 to 5 carbons, or

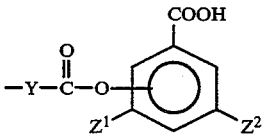

where Y is alkylene having 1 to 12 carbons, preferably 1 to 6 carbons, or arylene, and $Z^1$ and $Z^2$ are as described above.

Illustrative examples of acyloxy-t-alkylated benzoic acids useful in the toners and developers of the present invention include:

I

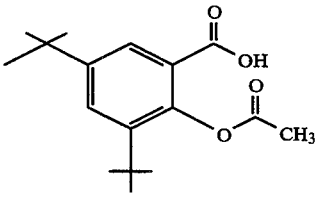

3,5-di-t-butyl-4-acetoxybenzoic acid,

II

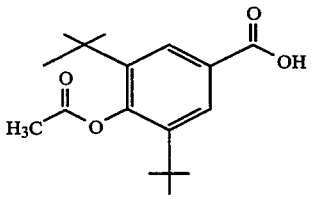

3,5-di-t-butyl-4-acetoxybenzoic acid,

III

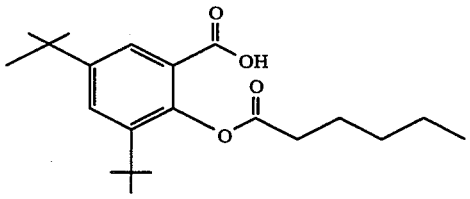

3,5-di-t-butyl-2-hexanoyloxybenzoic acid,

IV:

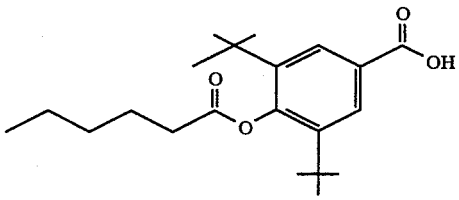

3,5 -di -t-butyl-4-hexanoyloxybenzoic acid,

V

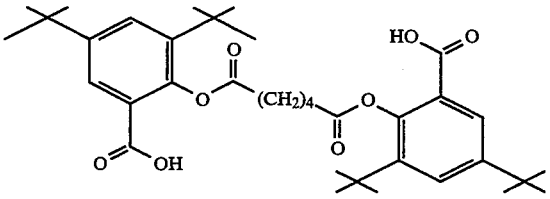

bis (2,4-di-t-butyl-6-carboxyphenyl) adipate,

VI

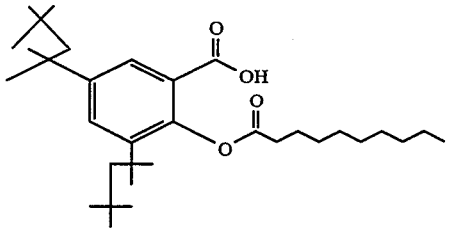

3,5-di-t-octyl-2-decanoyloxybenzoic acid,

VII

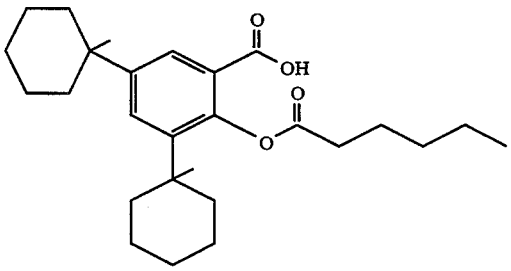

3,5-bis (1-methylcyclohexyl) -2-hexanoyloxybenzoic acid,

VIII

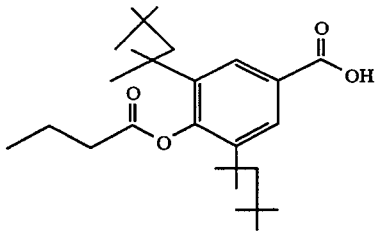

3,5-di-t-octyl-4-butyryloxybenzoic acid, and

IX

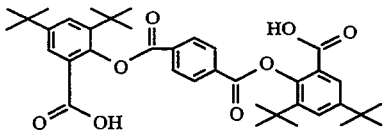

bis(2,4di-t-butyl-6-carboxyphenyl) terephthalate.

The acyloxy-t-alkylated benzoic acids can be prepared by the alcoholysis of acyl halides or anhydrides. These reactions are well-known in the art, for example, see J. March, *Advanced Organic Chemistry,* 3rd Ed. (John Wiley & Sons). The acyloxy-t-alkylated benzoic acids can be prepared from readily available starting materials, such as, 3,5-di-t-butylsalicylic acid available from Ferro Corp.; 3,5-di-t-butyl-4-hydroxybenzoic acid, decanoyl chloride, and butyryl chloride available from Aldrich Chemical Co.; and acetic anhydride, hexanoyl chloride, adipoyl chloride and terephthaloyl chloride available from Eastman Kodak Co.

For purposes of illustration, the syntheses of Compounds I and V are described below:

Synthesis of Compound I
(3,5-di-t-butyl-2-acetoxybenzoic acid)

A mixture of 18.125 g (0.0724 tool) of 3,5-di-t-butylsalicylic acid, 30 mL of acetic anhydride and 5 drops of concentrated $H_2SO_4$ was heated at reflux for 2 hours and cooled. The solution was poured into water. The solid precipitate was collected, washed with water, and dissolved in ether. The water layer was separated and the solution was washed again with water, dried over $MgSO_4$ and concentrated. To the oily residue was added 50 ml of ligroin (petroleum hydrocarbons with a boiling point of 35° C. to 60° C.). The crystallized solid was collected, washed with ligroin and dried to give 8.07 grams of product (38.12% of theory); melting point=159°-160° C.

The product 3,5-di-t-butyl-2-acetoxybenzoic acid was characterized by a combination of nuclear magnetic resonance spectroscopy (NMR) and combustion analysis. The combustion analysis found 69.99 percent by weight carbon and 8.21 percent by weight hydrogen. The analytical calculation for $C_{17}H_{24}O_4$ is 69.84 percent by weight carbon and 8.27 percent by weight hydrogen.

Synthesis of Compound V
(bis(2,4-di-t-butyl-6-carboxyphenyl) adipate)

A solution of 9.15 g (0.05 mol) of adipoyl chloride in 50 mL of dry ether was added dropwise to a solution of 25.03 g (0.10 mol) of 3,5-di-t-butylsalicylic acid, 10.12 g (0.10 mol) of triethylamine and 200 mL of dry ether over 15 minutes. The mixture was stirred for 3 hours and filtered. The filtrate was washed with water, dried over $MgSO_4$ and concentrated. The residue was recrystallized from ligroin (boiling point=35°-60° C.). The recrystallized solid was collected, washed with ligroin and dried. The yield of product was 14.7 g (48.1% of theory); melting point=199°-201° C.

The product bis(2,4-di-t-butyl-6carboxyphenyl) adipate was characterized by a combination of NMR, and combustion analysis. The combustion analysis measured 70.98 percent by weight carbon and 8.13 percent by weight hydrogen. The analytical calculation for $C_{36}H_{50}O_8$ is 70.79 percent by weight carbon and 8.25 percent by weight hydrogen.

The toners of this invention are prepared by the combination of one or more acyloxy-t-alkylated benzoic acids with appropriate toner binder material(s) and, if desired, other charge-control agent material(s) and/or other addenda by any convenient method, for example, by spray drying, melt dispersion, suspension polymerization or melt-blending. The preferred method is to melt-blend the toner components as described in, for example, U.S. Pat. Nos. 4,684,596 and 4,394,430. After melt-blending the charge-control agent material(s), toner binder material(s) and addenda, the mixture is then ground to the desired size to form a free-flowing toner.

Such toner particles can have an average diameter between about 0.1 μm and about 100 μm, preferably between about 1.0 μm and about 30 μm.

Generally, it is desirable to add from about 0.2 to about 7 percent by weight, preferably from about 0.4 to about 5 percent by weight charge-control agent material(s) to the toner binder. The optimum amount of charge-control agent in a toner will depend on the particular charge-control agent material(s), the particular toner binder(s), and other addenda, if any, in the toner. However, the ranges specified are typical of the useful ranges of charge-control agent utilized in conventional dry toners. For examples see Table I, in which the percentages of charge-control agent added to the toner varies from 0.94 percent by weight to 4.8 percent by weight.

Other charge-control agents are effective when combined with the acyloxy-t-alkylated benzoic acids to form the toners of this invention. Examples are amine charge-control agents such as described in U.S. Pat. No. 3,944,493, quaternary phosphonium charge-control agents such as described in U.S. Pat. No. 4,496,643, or quaternary ammonium charge-control agents such as described in U.S. Pat. Nos. 3,893,935; 4,323,634; 4,394,430; and 4,834,920. N-Benzyl-N,N-dimethyloctadecylammonium m-nitrobenzenesulfonate described in U.S. Pat. No. 4,834,920 is particularly effective when combined with acyloxy-t-alkylated benzoic acids to form the toners of this invention.

The toner binders combined with the acyloxy-t-alkylated charge-control agents to form the toners of the present invention can be binder polymers conventionally employed in electrostatic toners. Useful binder polymers generally have a glass transition temperature within the range of from 50° C. to 120° C. Preferably, toner particles prepared from these binder polymers have relatively high caking temperatures, for example, higher than about 60° C., so that the toners can be stored for relatively long periods of time at fairly high temperatures without having individual particles agglomerate and clump together. The softening point of useful binder polymers preferably is within the range of from about 60° C. to about 200° C. so that the toner particles can readily be fused to a conventional paper receiving sheet to form a permanent image. Especially preferred binder polymers are those having a softening point within the range of from about 60° to about 120° C. Where other types of receiving elements are used, for example, metal plates such as certain printing plates, binder polymers having softening points and glass transition temperatures higher than the values specified above can be used.

Among the various binder polymers which can be employed in toners comprising the acyloxy-t-alkylated benzoic acid charge-control agents are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units, as described in U.S. Pat. No. 3,809,554, and fusible cross-linked polymers as described in U.S. Pat. No. Re. 31,072.

Typical useful binder polymers include certain polycarbonates such as those described in U.S. Pat. No. 3,694,359, such as polycarbonate materials containing an alkylidene diarylene moiety in a recurring unit and having from 1 to about 10 carbon atoms in the alkyl moiety. Other useful binder polymers having the above-described physical properties are polymeric esters of acrylic and methacrylic acid such as poly(alkyl acrylate), and poly(alkyl methacrylate) wherein the alkyl moiety can contain from 1 to about 10 carbon atoms. Additionally, other polyesters having the aforementioned physical properties are also useful. Among such other useful polyesters are copolyesters prepared from terephthalic acid (including substituted terephthalic acid), a bis(hydroxyalkoxy)phenylalkane having from 1 to 4 carbon atoms in the alkane moiety (which can also be a halogen-substituted alkane), or an alkylene glycol having from 1 to 8 carbon atoms in the alkylene moiety, such as, 1,2-propanediol, neopentyl glycol, ethylene glycol and the like. The polyesters may also contain a branching agent such as glycerol, trimethylolpropane, pentaerythritol, trimellitic anhydride and the like.

Other useful binder polymers are various styrene-containing polymers. Such polymers can comprise, for example, a polymerized blend of from about 40 to about 100 percent by weight of styrene, from 0 to about 45 percent by weight of a lower alkyl acrylate or methacrylate having from 1 to about 4 carbon atoms in the alkyl moiety, such as, methyl, ethyl, isopropyl, and butyl and from about 0 to about 50 percent by weight of another vinyl monomer other than styrene, for example, a higher alkyl acrylate or methacrylate having from about 5 to 20 or more carbon atoms in the alkyl group. Typical styrene-containing polymers prepared from a copolymerized blend as described hereinabove are copolymers prepared from a monomeric blend of 40 to 80 percent by weight styrene or styrene homolog, from about 20 to about 45 percent by weight of a lower alkyl acrylate or methacrylate and from about 0 to about 30 percent by weight of a higher alkyl acrylate or methacrylate such as ethylhexyl acrylate, for example, styrene-butyl acrylate-ethylhexyl acrylate copolymer. Preferred fusible styrene copolymers are those which are covalently crosslinked with a small amount of a divinyl compound such as divinylbenzene. A variety of other useful styrene-containing binder polymers are disclosed in U.S. Pat. Nos. 2,917,460; Re 25,316; 2,788,288; 2,638,416; 2,618,552 and 2,659,670.

Various kinds of well-known addenda, for examples, colorants and release agents, can also be incorporated into toners containing the acyloxy-t-alkylated benzoic acid charge-control agents.

Without the addition of colorants, the toners comprising the acyloxy-t-alkylated benzoic acid charge-control agents can be clear toners depending on the selected toner binder and other addenda, if any. Clear toners have several uses, for example, they can be used to affect the gloss of an image. On the other hand, if colored toners are desired, they can be prepared by the addition of colorant to the toners. Numerous colorant materials selected from dyestuffs or pigments can be employed in the toners. The colorants can, in principle, be selected from virtually any of the compounds mentioned in the *Colour Index*, Volumes-1 and 2, Second Edition. Included among the vast number of useful colorants are such materials as Hansa Yellow G (C.I. 11680), Nigrosine Spirit soluble (C.I. 50415), Chromogen Black ETOO (C.I. 45170), Solvent Black 3 (C.I.26150), Fuchsine N (C.I. 42510), C.I. Basic Blue 9 (C.I. 52015). Carbon black also provides a useful colorant. The amount of colorant added may vary over a wide range, for example, from about 1 to about 20 percent of the weight of the binder polymer. Typically, good results are obtained when the amount of colorant is from about 1 to about 10 percent of the weight of the toner binder.

To prepare electrostatographic developers, toners containing acyloxy-t-alkylated benzoic acids can be mixed with a carrier to form two-component developers, or the toners can be formulated to achieve proper tribocharging in a single-component developer. The formation of two-component developers is preferred. The carrier used to form two-component developer compositions can be selected from a variety of materials. Such materials include carrier core particles with or without an overcoat of a thin layer of film-forming resin.

The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development systems are iron particles such as porous iron particles having oxidized surfaces, steel particles, and other "hard" or "soft" ferromagnetic materials such as gamma ferric oxides or ferrite, such as ferrites of barium, strontium, lead, magnesium, or aluminum. See, for example, U.S. Pat. Nos. 4,042,518; 4,478,925 and 4,546,060.

As noted above, the carrier particles can be overcoated with a thin layer of a film-forming resin for the purpose of establishing the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See, for example, U.S. Pat. Nos. 4,545,060;

4,478,925; 4,076,857 and 3,970,571. Such polymeric carrier resins can serve a number of known purposes. One such purpose is to shift the carrier particles to a position in the triboelectric series different from that of the uncoated carrier core material in order to adjust the degree of triboelectric charging of both the carrier and toner. Other purposes can be to reduce the frictional characteristics of the carrier particles in order to improve developer flow properties, and to reduce the surface hardness of the carrier particles so that they are less likely to break apart during use and less likely to abrade surfaces they contact. Another purpose can be to reduce the tendency of toner or developer additives from becoming permanently adhered to carrier surfaces during developer use (often referred to as scumming). A further purpose can be to alter the electrical resistance of the carrier particles.

A typical developer composition containing the above-described toner and a carrier generally comprises from about 1 to about 20 percent by weight of toner and from about 80 to about 99 percent by weight carrier. Usually, the carrier particles are larger than the toner particles. Conventional carrier particles have a particle size on the order of from about 10 to about 1200 microns, preferably 20 to 300 microns.

Toner and developer compositions containing acyloxy-t-alkylated benzoic acids can be used in a variety of ways to develop electrostatic images. Such developable electrostatic images can be prepared by a number of means on, for example, a light sensitive photoconductive image member or a non-light sensitive dielectric-surfaced element such as an insulator-coated conductive sheet. One suitable development technique involves cascading the developer composition across the electrostatic image member, while another technique involves applying toner particles from a magnetic brush. This latter technique involves the use of a magnetically attractable carrier vehicle in forming the developer composition. After imagewise deposition of the toner particles, the image can be fixed, for example, by heating the toner to cause it to fuse to the substrate carrying the toner. However, usually the unfused image is transferred from the electrostatic image member to a receiver such as a blank sheet of copy paper and then fused to form a permanent toner image.

The following examples are presented to illustrate the preparation of toners and developers comprising the acyloxy-t-alkylated benzoic acid charge-control agents with and without additional charge-control agent.

EXAMPLE 1

Preparation of Toner and Developer Containing Compound II (3,5-di-t-butyl-4-acetoxybenzoic acid) as the Charge-Control Agent A toner containing 3,5-di-t-butyl-4-acetoxybenzoic acid was prepared by mixing 0.94 percent by weight of compound II with 94.4 percent by weight toner binder and 4.7 percent by weight copper phthalocyanine pigment. The toner binder was a terpolymer of 77 percent by weight styrene, between 22 and 23 percent by weight of butyl acrylate and less than 1 percent by weight of divinylbenzene. The charge-control agent, toner binder and pigment were mixed, melt-blended on a two-roll mill, allowed to cool to room temperature and ground in a fluid energy mill to a particle size of 5 to 15 microns. The developer was prepared by combining 12 percent by weight of the toner with 88 percent by weight of carrier. The carrier was a strontium ferrite coated with a copolymer comprising 95 percent by weight of methyl methacrylate and 5 percent by weight p-t-butylstyrene. The carrier was prepared as described in U.S. Pat. No. 4,546,060.

The toner was tested for Q/M and dusting. The Q/M measurement was made using a 100 mg sample of developer. The 100 mg sample of developer was drawn from 4,000 mg of developer, made as described above, after the 4,000 mg of developer was agitated for 10 minutes in a 4 dram vial on a magnetic brush apparatus rotating at 2,000 RPM.

The T.O. measurement was made using the same 4,000 mg of developer used to measure the Q/M, less the 100 mg used to evaluate the Q/M. To this developer, 240 mg of additional toner was added. This mixture was shaken for 2 minutes at several Hertz in a 4 dram vial to simulate mixing and tribocharging under less than ideal conditions. After shaking, the developer was put on a magnetic brush over which a vacuum chamber was placed. The brush was rotated while a vacuum was applied. Poorly charged toner dusted from the carrier and was trapped on the filter paper. The weight of the toner collected on the filter paper was measured and recorded.

The results of the Q/M and dusting tests as well as the charge agent used to prepare the toner are listed in Table I.

EXAMPLE 2

Preparation of Toner and Developer Containing Compound II And Another Charge-Control Agent Material A toner containing charge-control agent consisting of two charge-control agent materials was prepared by combining 93.05 percent by weight of the same toner binder used in Example 1, 4.6 percent by weight copper phthalocyanine pigment, 1.9 percent by weight of compound II, and 0.48 percent by weight of another charge-control agent material, N-benzyl-N,N-dimethyloctadecylammonium m-nitrobenzenesulfonate (Compound X). N-Benzyl-N,N-dimethyloctadecylammonium m-nitrobenzenesulfonate has the following structure:

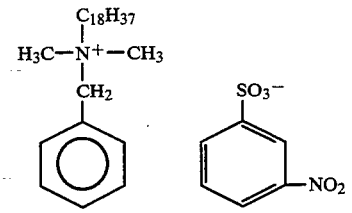

X

Compound X , a quaternary ammonium salt was prepared as disclosed in U.S. Pat. No. 4,834,920 which is incorporated herein by reference. The toner binder, pigment, and charge-control agent materials were melt-blended, cooled and ground the same way as indicated in Example 1. The developer was prepared as indicated in Example 1, except the toner from this example was used. Q/M and dusting were tested as in Example 1. The results appear in Table I.

EXAMPLES 3 THROUGH 8

Examples 3 Through 8 were prepared in the same way as Example 1 or Example 2 except that the toners contained differing amounts and types of charge-control agent materials. Q/M and dusting were tested as in Example 1. The results of the Q/M and dusting tests as well as the amounts and types of charge-control agents used to prepare the toners are listed in Table I.

Comparative Example 1

Preparation of Toner and Developer Containing No Charge-Control Agent

A toner containing no charge-control agent was prepared by combining 95.3 percent by weight of the same toner binder and 4.7 percent by weight of the same pigment as used in the Examples 1 and 2. The toner binder and pigment were mixed and ground as in Example 1 except that no charge agent was added. The developer was made as in Example 1 except that the toner of this example was used. Q/M and dusting were tested as in Example 1, and the results appear in Table I.

TABLE I

| Example No. | Charge-Control Agent(s) | Weight % of Charge-Control Agent(s) | Q/M (μc/g) | T.O. (mg) |
|---|---|---|---|---|
| 1 | II | 0.94 | −43.8 | 1.8 |
| 2 | II,X | 1.9, 0.48 | −24.8 | 2.3 |
| 3 | I | 1.9 | −44.6 | 1.4 |
| 4 | I,X | 1.9, 0.19 | −22.9 | 3.0 |
| 5 | I,X | 1.9, 0.48 | −17.4 | 6.2 |
| 6 | III | 1.9 | −41.8 | 0.6 |
| 7 | IV | 4.8 | −24.7 | 9.4 |
| 8 | V | 1.9 | −38.9 | 1.0 |
| CE1 | None | None | −55.2 | 2.5 |

From the results listed in the above table, it is evident that acyloxy-t-alkylated benzoic acids are excellent charge-control agent materials. The desired Q/M is between about −17 μC/g and about −45 μC/g for toners. The toners comprising the acyloxy-t-alkylated benzoic acid charge-control agent materials, Examples 1 through 8, had Q/M values within the desired range. On the other hand in Comparative Example 1 (CE1), when no charge-control agent was added to the toner formulation, the Q/M value was −55.2 μC/g, which is outside the desired range. For CE1, the higher Q/M in absolute terms, will result in less toner being transferred to an electrostatic image member, thereby producing a final toner image which is faint or undertoned. On the other hand, the toners of Examples 1 through 8 with acceptable Q/M values will produce final toner images with the proper density of toner.

The desired range for the dusting of the toners under the above-described test conditions is a T.O. between 0 and about 10 mg. For all of the examples, the results are within this range. For the toner without charge-control agent, CE1, a low T.O. can be expected, because as stated earlier, the T.O. decreases as the Q/M increases, and its Q/M was undesirably high. On the other hand, the acyloxy-t-alkylated benzoic acids in the toners were effective at controlling the Q/M values while at the same time maintaining dusting within the desirable range.

The invention has been described in detail with particular reference to preferred embodiments thereof, but it will be understood that variations and modifications can be effected within the spirit and scope of the invention.

What is claimed is:

1. A toner comprising binder and charge-control agent, said charge-control agent comprising an acyloxy-t-alkylated benzoic acid.

2. The toner of claim 1 wherein said acyloxy-t-alkylated benzoic acid comprises from about 0.2 to about 7 percent by weight.

3. The toner of claim 2 further comprising from about 0.4 to about 5 percent by weight charge-control agent.

4. The toner of claim 1 further comprising quaternary ammonium salt.

5. The toner of claim 1 further comprising N-benzyl-N,N-dimethyloctadecylammonium m-nitrobenzenesulfonate.

6. A developer comprising carrier and the toner of claim 1.

7. The developer of claim 6 further comprising charge-control agent selected from the group consisting of 3,5-di-t-butyl-2-acetoxybenzoic acid; 3,5-di-t-butyl-2-hexanoyloxybenzoic acid; 3,5-di-t-butyl-4-acetoxybenzoic acid; 3,5-di-t-butyl-4-hexanoyloxybenzoic acid; and bis(2,4-di-t-butyl-6-carboxyphenyl) adipate.

8. The developer of claim 6 further comprising quaternary ammonium salt.

9. A toner comprising binder and a charge-control agent having the structure:

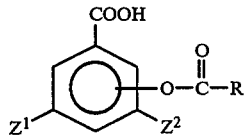

where $Z^1$ and $Z^2$ are independently selected tertiary alkyl groups having from 4 to 8 carbons, and R is alkyl having 1 to 12 carbons, or

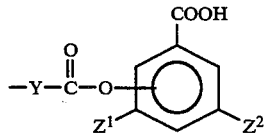

where Y is alkylene having from 1 to 12 carbons or arylene.

10. The toner of claim 9 wherein $Z^1$ and $Z^2$ are independently selected from the group consisting of t-butyl, t-octyl and 1-methylcyclohexyl.

11. The toner of claim 9 wherein $Z^1$ and $Z^2$ are the same group.

12. The toner of claim 9 wherein $Z^1$ and $Z^2$ are both t-butyl.

13. The toner of claim 9 wherein R is an alkyl having from 1 to 5 carbons.

14. The toner of claim 9 wherein Y is an alkylene having from 1 to 6 carbons.

15. The toner of claim 9 wherein

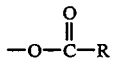

is para to —COOH.

16. The toner of claim 9 wherein

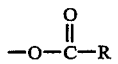

is ortho to —COOH.

17. The toner of claim 9 wherein

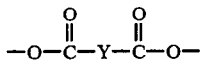

is para to both —COOH groups.

18. The toner of claim 9 wherein

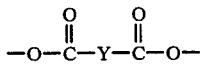

is ortho to both —COOH groups.

19. The toner of claim 9 wherein said acyloxy-t-alkylated benzoic acid is selected from the group consisting of 3,5-di-t-butyl-4-acetoxybenzoic acid; 3,5-di-t-butyl-2-hexanoyloxybenzoic acid; 3,5-di-t-butyl-2-acetoxybenzoic acid; 3,5-di-t-butyl-4-hexanoyloxybenzoic acid; and bis(2,4-di-t-butyl-6-carboxyphenyl) adipate.

20. A toner comprising binder and from about 0.2 to about 7 percent by weight charge-control agent, said charge-control agent having the structure:

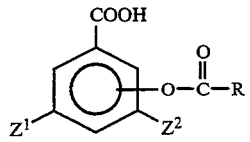

where $Z^1$ and $Z^2$ are independently selected tertiary alkyl groups having from 4 to 8 carbons, and R is alkyl having from 1 to 12 carbons, or

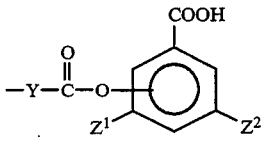

where Y is alkylene having 1 to 12 carbons or arylene.

21. A toner composition comprising acyloxy-t-alkylated benzoic acid.

* * * * *